US006676893B2

(12) United States Patent
Rolander et al.

(10) Patent No.: US 6,676,893 B2
(45) **Date of Patent: *Jan. 13, 2004**

(54) POROUS CUBIC BORON NITRIDE BASED MATERIAL SUITABLE FOR SUBSEQUENT PRODUCTION OF CUTTING TOOLS AND METHOD FOR ITS PRODUCTION

(75) Inventors: Ulf Rolander, Stockholm (SE); Gerold Weinl, Älvsjö (SE)

(73) Assignee: Sandvik AB, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/131,074

(22) Filed: Apr. 25, 2002

(65) Prior Publication Data

US 2002/0112408 A1 Aug. 22, 2002

Related U.S. Application Data

(62) Division of application No. 09/543,354, filed on Apr. 5, 2000, now abandoned.

(30) Foreign Application Priority Data

Apr. 7, 1999 (SE) ..... 9901222

(51) Int. Cl.[7] ..... B22F 7/06

(52) U.S. Cl. ..... 419/8; 419/9; 419/13; 419/14; 419/18; 419/36; 419/38; 419/48; 419/49

(58) Field of Search ..... 419/13, 8, 9, 14, 419/18, 38, 48, 49, 36, 60

(56) References Cited

U.S. PATENT DOCUMENTS

| | | | | |
|---|---|---|---|---|
| 4,224,380 A | | 9/1980 | Bovenkirk et al. | |
| 4,770,907 A | | 9/1988 | Kimura | |
| 5,676,496 A | | 10/1997 | Littecke et al. | |
| 5,718,736 A | | 2/1998 | Onishi et al. | |
| 6,140,262 A | * | 10/2000 | Collier et al. | 501/96.4 |
| 6,287,489 B1 | * | 9/2001 | Rolander et al. | 264/6 |

FOREIGN PATENT DOCUMENTS

| | | |
|---|---|---|
| DE | 19506692 | 2/1995 |
| EP | 211247 | 7/1986 |
| EP | 203233 | 9/1987 |
| JP | 2252661 | 10/1990 |
| JP | 4083759 | 3/1992 |
| RU | 2039631 | 8/1993 |
| WO | 9803691 | 1/1998 |

* cited by examiner

*Primary Examiner*—Daniel J. Jenkins
(74) *Attorney, Agent, or Firm*—Burns, Doane, Swecker & Mathis, LLP

(57) ABSTRACT

The presently claimed invention relates to a method of making a PcBN cutting tool insert. The method includes the following steps:

mixing raw material powders, (e.g., cBN, hBN, TiC, TiN, Ti(C,N), WC, W, C, Co, $Co_2Al_9$, Al AlN, $Al_2O_3$) with a liquid (e.g., ethanol) and an agent (e.g., polyethylene glycol, PEG) to form a homogeneous slurry with the desired composition;

forming spherical powder agglomerates, typically 100 $\mu$m in diameter, preferably by spray drying;

pressing said agglomerates to form a body of desired dimensions and density using conventional tool pressing technology;

removing the agent from the powder at a suitable temperature and atmosphere;

raising the temperature to 1000–1350° C. in vacuum;

solid state sintering the body at 1000–1350° C. in vacuum, for 1–90 minutes to form a body with 35–55 vol % porosity;

optionally, adding 0.5–1000 mbar of nitrogen to the sintering atmosphere at the hold time or during cooling; and HP/HT treating the porous body to form a dense body of desired shape and dimension.

10 Claims, 1 Drawing Sheet

POROUS CUBIC BORON NITRIDE BASED MATERIAL SUITABLE FOR SUBSEQUENT PRODUCTION OF CUTTING TOOLS AND METHOD FOR ITS PRODUCTION

This application is a divisional of application Ser. No. 09/543,354, filed on Apr. 5, 2000, now abandoned.

BACKGROUND OF THE INVENTION

The present invention relates to a method of making tools with cutting edges formed of polycrystalline cubic boron nitride (PcBN) which are bonded to a body of cemented carbide or cermet.

Cutting tools having cutting edges formed of a super hard abrasive such as a cubic boron nitride (cBN)-based material are manufactured by powder metallurgical techniques and are mainly used for the machining of cast iron and hardened steel. For cast iron, a tough material with 80–100 wt % cBN is used, while for hardened steel 10–50 wt % of TiC, TiN or Ti(C,N) is usually added. This addition decreases toughness, but greatly improves the chemical stability of the material. Most often, the PcBN (polycrystalline cubic Boron Nitride) material also contains smaller amounts (typically <10 wt % each with a total maximum content of all such materials being 25 wt %) of other components, e.g., Co, Ni, WC, Al, AlN and $Al_2O_3$. These are either added to the raw material powder or obtained during processing.

PcBN cutting tools are mainly produced in two different ways:

i) By high pressure/high temperature (HP/HT) sintering of a PcBN powder mixture into a solid body that is cut and ground into a finished cutting tool insert; or ii) By HP/HT-sintering a thin layer of PcBN powder which simultaneously bonds to a substrate (usually a cemented carbide disc), from which smaller pieces (chips) are cut out. These chips are brazed onto a regular carbide tool (e.g., insert, end-mill, drill) and ground to the finished state. The tools are relatively expensive to produce due to the many steps the product must undergo before it is finished. Also, usually only one or two cutting edges per tool are available.

Through U.S. Pat. No. 5,676,496, a technique is known for producing PcBN cutting tool inserts in a more cost efficient way. This is achieved by placing a cemented carbide or cermet substrate into a container and then packing PcBN powder into appropriately placed grooves in a substrate. The container is then HP/HT-sintered so that the PcBN powder is consolidated to a fully dense body, which is simultaneously bonded to the substrate. The substrate/PcBN compound may then directly be ground to a cutting tool insert. The main advantages with this technique are:

1. The brazing step is eliminated; and
2. The number of cutting edges per insert can be increased at a limited added production cost.

Although the method described leads to extensive cost reductions per cutting edge, it has one major drawback in that the packing of a powder mixture containing PcBN into the grooves in principle must be done manually. The poor flow properties of PcBN powder in combination with the required groove geometry make automatic processing unreliable. Apart from obvious health hazards, manual packing may lead to uneven packing density and to excessive oxygen exposure of the PcBN powder. Uneven packing density makes it necessary to choose a larger groove dimension than desired to ensure that the amount of PcBN obtained is always sufficient. Careful control of the oxygen content in the PcBN powder is critical for the HP/HT sintering since excessive oxygen negatively affects the consolidation process. In principle, one would like to have a high and highly reproducible packing density and to minimize the oxygen pickup during handling and storage.

OBJECTS AND SUMMARY OF THE INVENTION

It is an object of this invention to avoid or alleviate the problems of the prior art.

It is further an object of this invention to provide a method of making tools with cutting edges formed of polycrystalline cubic boron nitride (PcBN) which are bonded to a body of cemented carbide or cermet.

It is an aspect of the invention to provide a method of making a PcBN or diamond cutting tool insert comprising:

mixing PcBN powder with a liquid and a pressing agent to form a homogenous slurry of a desired composition;

forming powder agglomerates of said mixture;

pressing said agglomerates to form a body of desired dimensions and density;

removing the pressing agent from the body at a suitable temperature and atmosphere;

raising the temperature to 1000°–1350° C. in vacuum;

solid state sintering the body at 1000–1350° C. in vacuum for 1–90 minutes to form a body with 35–55 vol % porosity; and treating the porous body under HP/HT conditions to form a dense body of desired shape and dimension.

DETAILED DESCRIPTION OF THE PREFERRED EMBODIMENTS OF THE INVENTION

Figure 1:
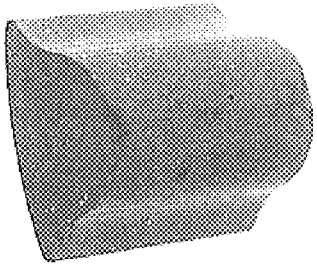
FIG. 1 is a representative presintered body of the present invention.

It has quite surprisingly been found that a green body of cBN-based material may be presintered in a vacuum sintering process at relatively high temperature to obtain a porous body with reasonable strength and well-defined shape. With a proper choice of sintering conditions, the material does not undergo phase transformations detrimental for subsequent HP/HT sintering or cutting tool performance. In particular, excessive phase transformation of the metastable cBN grains into, e.g., hexagonal boron nitride (hBN) or metal borides and nitrides can be avoided. Furthermore, the presintering process can be designed to include dewaxing, oxygen reduction and, optionally, nitrification of the green body.

In one aspect of the invention there is provided a presintered porous, porosity 35–55 vol %, body comprising cBN which is particularly well-suited for further HT/HP sintering in that it has the following properties:

1. It can be produced in complicated shapes with tight tolerances and highly reproducible green body density using normal automatic tool pressing technology;

2. It has sufficient strength for automatic assembly, e.g., together with carbide substrates, into suitable containers;
3. The porous structure is sufficiently fragile to collapse during HP/HT sintering leaving no residual cracks or flaws and essentially no residual porosity; and
4. The material has a low and stable oxygen content (typically <0.6 wt %) which facilitates storage over an extended time period with low oxygen pickup and easy handling.

In a second aspect of the invention, there is provided a powder metallurgical method of producing the material described above, comprising the following steps:

1. Mixing raw material powders, i.e., cBN and one or more of, e.g., hBN (hexagonal Boron Nitride), TiC, TiN, Ti(C,N), WC, W, C, Co, $Co_2Al_9$, Al AlN, $Al_2O_3$ in conventional amounts as discussed above (that is, up to 50 wt % of TiC, TiN, and/or Ti(C,N) and up to 25 wt % of the total of the others), with a suitable liquid (e.g., ethanol) and a pressing agent (e.g., polyethylene glycol, PEG) to form a homogeneous slurry with the desired composition. The agent acts to form the agglomerates as a binder. The liquid should be a solvent for the agent and should be removable at temperatures up to about 400° C. Various combinations of liquid/agent are determinable by those of ordinary skill in the art.
2. Forming spherical powder agglomerates, typically from 50 to 100 $\mu$m, usually about 100 $\mu$m in diameter, with good flow properties using the spray drying technique.
3. Processing said agglomerates to form a body of desired dimensions and density using conventional tool pressing technology.
4. Removing the pressing agent from the powder at a suitable temperature and atmosphere less than the sintering temperature (preferably 200°–400° C. in flowing hydrogen for PEG).
5. Removing oxygen from the raw material grain surfaces by raising the temperature to 1000–1350° C. in vacuum;
6. Solid state sintering the material at 1000–1350° C. in vacuum, for 1–90 minutes to obtain the desired strength;
7. Optionally, adding 0.5–1000 mbar of nitrogen to the sintering atmosphere at the hold time or during cooling to compensate for the loss of insterstitial elements during oxygen removal; and
8. Subjecting the sintered porous body to an HP/HT treatment to obtain a dense PcBN body of desired shape and dimensions, e.g., a cutting tool insert. During this treatment, the porous body may alternatively be in contact with a sintered body of cemented carbide or cermet and during the HP/HT treatment be attached to it and form a composite body, again, e.g., a cutting tool. The HP/HT treatment is conventional and is disclosed, e.g., in U.S. Pat. No. 5,676,496.

It is obvious that the method according to the invention can be used to make inserts of other types than those according to U.S. Pat. No. 5,676,496 as well as tools or tool bodies of solid PcBN with complicated shape, e.g., inserts with a chip breaker or with a central hole for clamping.

The invention is additionally illustrated in connection with the following Examples which are to be considered as illustrative of the present invention. It should be understood, however, that the invention is not limited to the specific details of the Examples.

EXAMPLE

A cutting tool insert according to U.S. Pat. No. 5,676,496 was made according to the present invention. 57 wt % cBN, 35 wt % $Ti(C_{0.5},N_{0.5})$ and 8 wt % $Co_2Al_9$ was first attritor-milled for 60 minutes using cemented carbide milling bodies to obtain a homogeneous powder mixture. 6.5% polyethylene glycol, PEG, was then added and the powder mixed in ethanol to a homogeneous slurry. The slurry was dried using the spray drying technique to a powder with an average agglomerate size of about 100 $\mu$m and good flow properties. The powder was pressed to a body with desired dimensions using conventional tool pressing technology. The pressing was done at the highest possible compaction pressure without jeopardizing the press tool in order to obtain a high green body density. The pressing agent was removed from the green bodies at 200–320° C. in flowing hydrogen. The temperature was increased to 1050° C. at 10° C./min in vacuum and then further increased to 1300° C. at 2° C./min in vacuum. During the temperature increase, oxygen leaves the green body as carbon monoxide and there is also some loss of nitrogen. Solid state sintering of the material took place at 1300° C. in vacuum for 30 minutes. The furnace was then allowed to cool down to room temperature in flowing argon gas.

After solid state sintering, the dimensions and density of the body were measured. The dimensions were slightly larger than for the green body, corresponding to a linear expansion of about 1%. The density was 2.33 g/cm$^3$ compared to 2.50 g/cm$^3$ for the green body. This corresponds to a weight loss of 6.5 wt % PEG and 0.7 wt % of carbon monoxide and nitrogen. Considering that the theoretical density for a fully dense body with the composition above is 3.93 g/cm$^3$, including inevitable pick-up of tungsten carbide (WC) and cobalt (Co) originating from the milling bodies, the density of the solid state sintered body corresponds to 41 vol % porosity. This is a relatively low value for tool pressed bodies with the pressing agent removed, presumably due to the high compaction pressure used. Typical values for, e.g., tool-pressed cemented carbide bodies lie in the range 35–60 vol % porosity.

Due to the loss of 0.7 wt % interstitials, the surfaces of the grains in contact with the porosity will be highly substoichiometric. This can be a problem since these surfaces may reoxidize during prolonged storage. However, by adding nitrogen to the sintering atmosphere, preferably at the end of the hold time at temperature, these surfaces will be nitrided and the stoichiometry in this way increased. This substantially decreases the risk of reoxidation.

The sintered PcBN body is then used to manufacture a cutting tool insert as illustrated in FIGS. 1–4 which show the manufacture of an insert according to the above-mentioned U.S. Pat. No. 5,676,496.

FIG. 1 shows the presintered body obtained. This particular body has a cylindrical shape with a complex cross-section and fits snugly into the grooves of the cemented carbide substrate shown in FIG. 2, which shows a sintered cemented carbide substrate intended for the production of a cutting tool insert with six PcBN cutting edges. Three grooves are placed symmetrically along the periphery. From each groove, two cutting edges are obtained, one on each side of the substrate.

Figure 2:
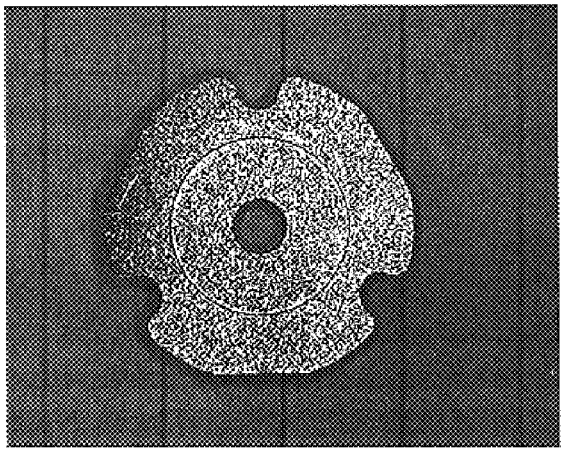
FIG. 2 is a representative sintered cemented carbide substrate with grooves for receiving the presintered body of FIG. 1.
Figure 3:
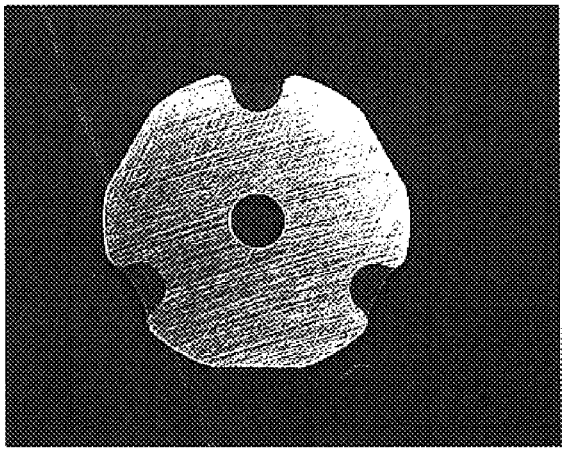
FIG. 3 is the assembly of the presintered body of FIG. 1 and the sintered cemented substrate of FIG. 2.
Figure 4:
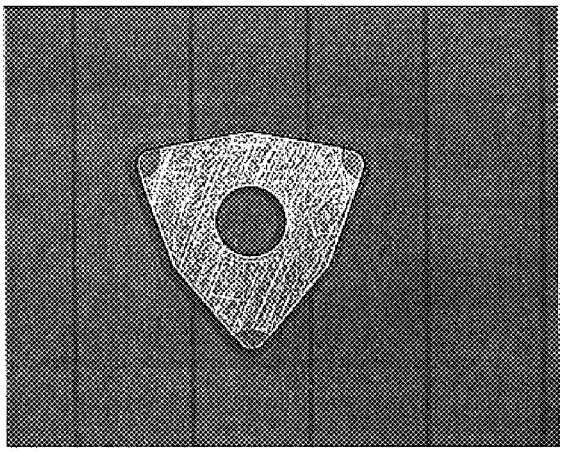
FIG. 4 is a cutting insert made from the assembly of FIG. 3.

Presintered bodies were placed in the grooves of the cemented carbide substrate of FIG. 2, placed in a container and subjected to a HP/HT treatment at about 50 kbar and 1450° C. for 20 minutes. FIG. 3 shows the substrate+PcBN blank after HP/HT sintering and removal of the container material from the top side. The porous presintered bodies which were placed in the grooves had collapsed into the grooves and formed fully dense PcBN material which is strongly bonded to the inner walls of the grooves. Finally, the blank was ground to a WNGA style insert with six cutting edges, FIG. 4.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a PcBN cutting tool insert comprising:

mixing PcBN powder with a liquid and a pressing agent to form a homogenous slurry of a desired composition;

forming powder agglomerates of said mixture;

pressing said agglomerates to form a body of desired dimensions and density;

removing the pressing agent from the body at a suitable temperature and atmosphere;

raising the temperature to 1000°–1350° C. in vacuum;

solid state sintering the body at 1000–1350° C. in vacuum for 1–90 minutes to form a body with 35–55 vol % porosity; and treating the porous body under HP/HT conditions to form a dense body of desired shape and dimension.

2. The method of claim 1 wherein said porous PcBN body is placed in contact with a cemented carbide or cermet body and is attached thereto by the HP/HT-treatment.

3. The method of claim 1 wherein said PcBN powder is mixed with another powder selected from the group consisting of hBN, TiC, TiN, Ti(C,N), WC, W, C, Co, Ni, $Co_2Al_9$, Al, AlN, $Al_2O_3$ and mixtures thereof prior to pressing.

4. The method of claim 1 wherein the said another powder is TiC, TiN and/or Ti(C,N) present in amounts of from about 10 to 50 wt % of the composition.

5. The method of claim 1 wherein the said another powder is Co, Ni, $Co_2Al_9$, Al, AlN and/or $Al_2O_3$ present in amounts of up to 10 wt % of the composition.

6. The method of claim 1 wherein the spherical powder agglomerates have a diameter of from 50 to 200 $\mu$m.

7. The method of claim 6 wherein the spherical powder agglomerates are about 100 $\mu$m in diameter.

8. The method of claim 1 wherein the pressing agent is a polyethylene glycol.

9. The method of claim 1 wherein the liquid and pressing agent is removed by heating the agglomerates to a temperature of from about 200° to 400° C.

10. The method of claim 1 wherein the liquid and pressing agent is removed by heating in a hydrogen atmosphere.

* * * * *